United States Patent [19]

Fash et al.

[11] 4,434,200

[45] Feb. 28, 1984

[54] IMPREGNATED WOVEN FENCING PRODUCT

[75] Inventors: William G. Fash, Hackensack, N.J.; Delbert A. Davis, Kernersville, N.C.

[73] Assignee: Burlington Industries, Inc., Greensboro, N.C.

[21] Appl. No.: 963,890

[22] Filed: Nov. 27, 1978

Related U.S. Application Data

[63] Continuation-in-part of Ser. No. 773,156, Mar. 1, 1977, abandoned, which is a continuation of Ser. No. 355,733, Apr. 30, 1973, abandoned, which is a continuation-in-part of Ser. No. 134,237, Apr. 15, 1971, abandoned.

[51] Int. Cl.[3] ..... B32B 7/00

[52] U.S. Cl. ..... 428/257; 428/255; 428/265; 428/267

[58] Field of Search ..... 428/257, 265, 267, 255

[56] References Cited

U.S. PATENT DOCUMENTS 2,827,414 3/1958 Bussard et al. .
3,417,794 12/1968 Lynch et al. ..... 139/420
3,501,366 3/1970 Bramley et al. .

*Primary Examiner*—James J. Bell
*Attorney, Agent, or Firm*—Cushman, Darby & Cushman

[57] ABSTRACT

A woven fencing product, flexible at normal temperatures yet of increased stability at cool temperatures, woven in an open weave pattern from a suitable fiber such as nylon, polyester and the like and impregnated with an elastomeric polymer is disclosed. The finished fabric is stable at relatively low winter temperatures, resistant to abrasion and ultra-violet light degradation and is suitable for use as a fencing material, such as snow fencing.

6 Claims, 1 Drawing Figure

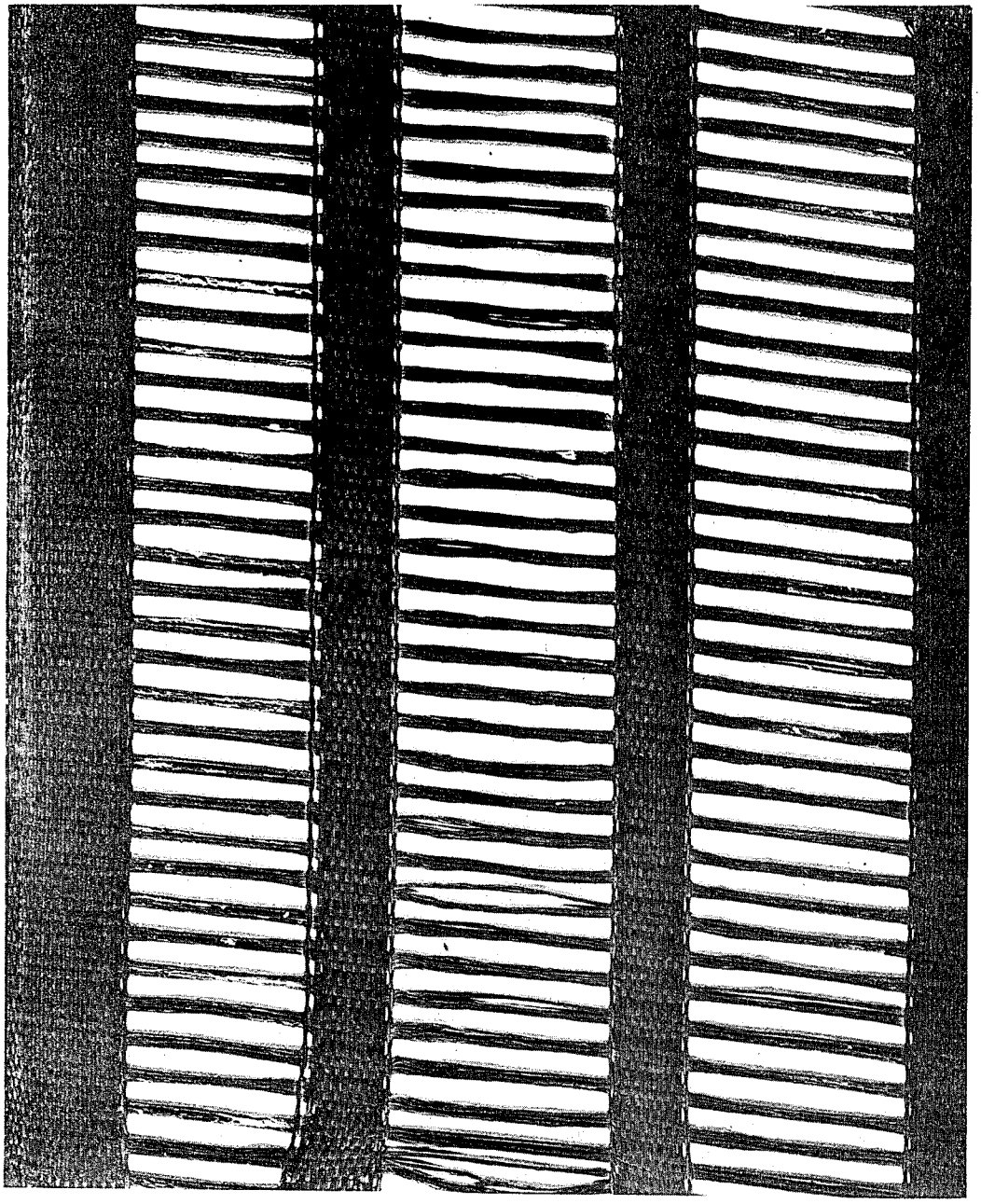

IMPREGNATED WOVEN FENCING PRODUCT

CROSS REFERENCE TO RELATED APPLICATIONS

This application is a continuation-in-part of our earlier application Ser. No. 773,156, filed Mar. 1, 1977 and now abandoned, which in turn is a continuation of our earlier application Ser. No. 355,733, filed Apr. 30, 1973 and now abandoned, which in turn is a continuation-in-part of our earlier application Ser. No. 134,237, filed Apr. 15, 1971 and now abandoned.

BACKGROUND OF THE INVENTION

This invention relates to improvements in flexible fencing products which are useful for shielding and decorative purposes and more particularly to a woven fencing product which is protected to render it resistant to ultra-violet degradation, is easy to handle at normal temperatures and yet becomes relatively more stable at cooler winter temperatures, optionally having woven therein a plurality of open spaces which are arranged and constructed in such a manner as to assist in the use of the fabric as a fencing product.

It is already known to make fencing products from woven material such as, for example, canvas and the like. These products, when used as fencing materials, are fastened to posts or stakes that are fixed into the earth and spaced along the length of the fence as support means. It is also known to provide some form of post-receiving passageway through or on a flexible product for receiving posts or stakes that are used in supporting the fencing product, as shown, for example, in U.S. Pat. No. 2,118,474. However, a fencing material which is capable of withstanding extremely cold temperatures with concomitant extended periods of exposure to sunlight without degradation of the woven product and the individual fibers thereof has heretofore not been known.

BRIEF DESCRIPTION OF THE INVENTION

The present invention provides for a lightweight easily handled fencing product which is capable of withstanding sustained periods of direct sunlight and/or cold temperatures without adversely affecting the properties thereof. In accordance with the present invention a woven fabric is formed having a plurality of open spaces therein from a fibrous material such as nylon or polyester to which an elastomeric composition containing one or more ultra-violet sun screens has been applied. The elastomeric finish provides the fence with stability at low temperatures, i.e., −10° to 30° F., abrasion resistance to fine particulate matter such as sand and resistance to oxidation and sunlight degradation caused by ultra-violet light rays. In one embodiment of the present invention, the finished woven fabric includes within its woven structure a plurality of spaces.

Other features and advantages of this invention will become apparent in the more detailed description which follows, and in that description reference will be made to the accompanying drawings as briefly described below.

BRIEF DESCRIPTION OF THE DRAWINGS

FIG. 1 is a photo-reproduction of a section of woven fabric in a decorative pattern woven from filament nylon, coated and impregnated with the elastomeric composition according to the invention. In use the relatively wide tightly-woven bands are usually placed in a horizontal relationship with respect to the ground surface.

DETAILED DESCRIPTION OF THE INVENTION

The present invention is concerned with providing an improved fencing product which has a variety of uses and which is pleasing in appearance. This specification will describe the product as being useful for snow fencing and generally for erosion control purposes; these descriptions are intended to include a wide variety of uses and adaptations of the product. For example, it is contemplated that the fencing product of the present invention be used in any number of the following illustrative embodiments: as a yard fencing; as a decorative screen around the home, or as a wind screen or at the beach to prevent the erosion of sand; to serve as guide markers on ski trails; to direct ski traffic; to provide crowd control at sporting events such as golf matches, ski meets and the like; as a guide to audiences to direct them to their proper places through the use of an appropriate color; and as decorative and protective screening around trailer courts, camps, patios and backyards, outdoor swimming pools and the like.

When desired, the fencing material is impregnated with an elastomeric composition containing a pigment or mixture of pigments. It is also possible to treat the fencing product so that it conducts electricity by incorporating one or more electroconductive materials in the elastomeric polymer composition before it is applied to the woven material. The resulting electroconductive product is useful for animal stock control. Another use to which an electroconductive material of the present invention is placed is that of a security fencing; when the integrity of the fence is broken, an electrical circuit connected thereto is opened thereby activating an alarm or similar warning device.

As previously stated the impregnated product is most advantageously used as a snow fencing and exhibits the particular advantageous property of not forming a sail in high winds. Of course, it is much lighter than wood slat snow fencing, more easily transported, unrolled and erected, and more easily cut, formed and shaped into the desired contours and lengths that are used for this particular application. Economies alone realized in the labor saved during the erection of the fence are significant.

Another important aspect of the present invention is using the finished fencing product for control and direction of underwater currents. Control of underwater currents by the finished fencing product when properly placed has a significant influence on the deposition of silt and sand on the floor channels, canals and other water-way passages. Depending on the character of the underwater current, proper placement of the fencing may direct the current and prevent the build-up of deposits thereby reducing the necessity or frequency of dredging presently required to keep waterways open to a depth necessary for the passage of ships and boats. On the other hand, if silt deposition in a particular area is desired, it is easily directed by the appropriate placement of the fencing thereby permitting the building of a base in relatively shallow water on which fill could be poured. The resulting silt deposit forms a basis for the recovery of land from water by adding to and increasing the amount of available shoreline or even straightening it and directing it where desired.

In another important aspect of the present invention the woven fencing product may be woven from non-flammable fibers such as asbestos, fiber glass, Nomex or a similar non-flammable filament fiber then impregnated with the elastomeric composition. The resulting product is used to provide protection from the spread of grass, brush or similar ground-base fires. Such a non-flammable fence provides a barrier or break which inhibits the spread of ground fires and the attendant damage that such fires can do through their uncontrolled spread. A fencing made of such non-flammable material is easily transported and installed by fire-fighters to assist in the control of widespread major brush and grass fires or, in anticipation of such fires, the fence installed in a potentially dangerous area during period of drought when such fires normally occur, as for example southern California. Flame retardants may optionally be included in the elastomeric composition, in the fiber to be impregnated or both.

The weave pattern of the woven product is especially designed to produce aerodynamic effects which are intended to control the fluid movement of various natural elements such as, for example, sand and snow, controlling the drifting properties of these materials by building controlled drifts. In the case of sand, these controlled drifts may be advantageously utilized to protect shorelines in beach areas from erosion by preventing sand scouring from carrying the sand from the shore into the ocean. The drifts form dunes creating blocks against which further sand will continue to deposit, thereby increasing the height and width of the resulting dune. Also, the woven design of the fence permits a certain amount of wind to pass through the fence thereby obviating a sailing effect which is encountered with other woven products known in the art, as for example canvas.

The appearance and weave of the fencing product of the present invention may take any convenient form and may be woven by known techniques as will be recognized by a person skilled in the art from an inspection of FIG. 1. There are provided open areas alternating with rows of relatively solid areas for strength, the open areas of sufficient size so as to engage a support means such as a plastic post or the like. The elastomeric compositions, as described hereinafter, are then applied to impregnate and encapsulate the product thus woven preferably thoroughly saturating the fabric thereby encapsulating every filament of every end and pick.

When the resulting impregnated woven product is used as a snow fence, color codes may be imparted to the fence by impregnating or optionally coating the woven fencing material with various pigment-containing elastomeric polymers. In this manner various ski trails can be conveniently color coded as to indicate the degree of difficulty, thereby warning the novice away from the expert trail. In addition to the color coding, the fabric snow fence exhibits certain safety features not previously realized. For example, a skier losing control on a ski trail can very easily hit a wooden fence, which is used to mark the trail, and engage one or more skis in the wooden fence thereby damaging the equipment and possibly injuring himself. A woven snow fence according to the present invention will remain tight at skiing temperatures but contain sufficient modulus to stop the skier or at least cushion his fall, thereby preventing serious injury to the skier and his equipment. Properly impregnated with selected pigments, the fencing may be installed on highway median strips, particularly on curves so disposed that the headlights of oncoming cars shine directly into the eyes of drivers. The erection of this type of fence at such points will diffuse the light from the headlights so as to reduce and soften the glare, thus aiding the driver so exposed in maintaining proper vision and thereby reducing the hazard of accidents.

In another embodiment of the present invention a conductive material may be admixed with the elastomeric finishing composition, as for example, conductive carbon black or finely powdered aluminum. Of course, discrete copper wires and the like may be woven into the fencing product prior to finishing such wires being of particular advantage when the fence is used for security purposes. These discrete wires would be subjected to the application of the elastomeric compositions as are the filament fibers of the fencing product itself, thereby decreasing their ability to transmit an electrical current when the respective portion of the fencing product is engaged by an animal. The resulting product would therefore be less effective as an electroconductive livestock fence.

The elastomeric finishing composition, through formula variation, in addition to improving the resistance to ultra-violet light in oxygen degradation, may be used as a base for printing directions or advertisements directly on the finished fencing product. Such imprinting may include, for example, logos, metallions, emblems, warnings or other desirable indicia. It has been found through suitable pigmentation that, together with other screening ingredients, the sun fastness of the acrylic polymers of elastomeric polymers employed is enhanced and reinforced. While it is also possible to use "Dope-dyed" or solution-dyed fabrics such as nylon or polyester during weaving in order to achieve a colored ultimate product, it will be appreciated that the preferred method of producing a colored product is to incorporate one or more pigments in the elastomeric finishing composition, as previously described. A combination of both dyed yarn and pigmented finishing compositions can also be used.

The woven product is characterized as being weather-resistant, especially adapted as a fencing or screening material, as described above, having a length of fabric woven in a predetermined width from strands of a tough synthetic plastic material, and having laterally-spaced longitudinal bands or relatively tightly woven warp and filling strands which are separated by relative open longitudinal bands containing only filament strands. The open bands permit passage of wind through the woven product without damage to the fabric while at the same time, creating air currents to cause deposition of drifts of snow or other particulate matter such as sand adjacent the woven product. The woven product also exhibits a certain degree of elasticity which makes it particularly attractive for fencing material near areas of active sports, for example baseball fields, playing fields, playgrounds, and the like.

The elastomeric composition, as described in more detail below, is distributed and adhered to the outside surface of woven fabric in a substantially even manner and in most cases will be impregnated into the fibers themselves. This impregnation aids in bonding the coating to the fibers, adhering the fibers to each other and depending on the nature of the elastomeric composition, helps to partially support and rigidify the woven product. The elastomeric coating is typically relatively thin, with respect to the strands of the woven product, and is preferably applied to have a relative thickness no greater than the diameter of each of the strands of the woven product. The elastomeric composition renders the product capable of withstanding sustained periods of direct sunlight.

As an illustrative embodiment of the present invention the fabric which is shown in FIG. 1 is woven from 840 denier filament polyester and is useful as snow fencing. A typical construction would have the following characteristics:

Width: 45.5 to 46.5,

Weight per Square Yard: 2.85 ounces,

Count: 11×14 picks, ends dispersed in bands one wide with approximately 26 ends in each band.

Tensile Strength of One Inch Strip: 400 lbs. warp (26 ends), 225 lbs. fill (14 ends).

Nylon of 840 denier can also be used to form the woven fabric generally in line with the above specifications.

The fabric thus woven is then finished with a polymeric material as described hereinafter. As used throughout this specification and claims, the term "finished" indicates that an elastomeric has been applied to the woven product. "Finished" encompasses "impregnated," wherein the composition penetrates into the fibers themselves and "coated," wherein the composition remains substantially on the fiber surface. Preferably the woven fabric is impregnated. As the fabric fiber employed there may be used a wide variety of textile fibers including cotton, silk, linen, acrylic polymers such as polyacrylonitrile; polymers of alpha-olefins such as polypropylene; nylon such as nylon 66 and nylon 6, nylon 6, 10 and polyesters such as polyethylene terephthalate disclosed in Winfield 2,465,319, polyethylene terephthalateisophthalate and polycyclohexane dimethanol terephthalate disclosed in Kibler U.S. Pat. No. 2,901,466. Fibers of a fire-resistant material, such as fiberglass, asbestos and Nomex are also useful. Nylon and polyester fibers are preferred. Polyester fibers are preferred in some installations for their dimensional stability. Polyester fabric, when properly installed and supported by posts, was found to maintain its dimension under changes in temperature and humidity.

When resorcinol-dyed nylon is used it is possible to dissolve at least part of the dyed nylon fabric in order to impart a degree of stiffness; however, these methods are not preferred as the resulting impregnated product generally remains stiff even at temperatures of about 50° to 70° F. thereby impairing the ease of handling. If the fabric fiber employed is acrylic, methylene chloride is advantageously employed as the solvent while ethylene dichloride is employed with a polypropylene fabric fiber. In both cases the application of the organic solvent causes the fibers of the material coated to fuse together thereby imparting some degree of stiffness.

The fibers described above generally do not by themselves possess the requisite desirable properties of hand and resiliency. These materials are highly susceptible to degradation caused by ultra-violet light, as well as oxidation from exposure to the elements and abrasion in certain installations. For these reasons among others, the material must be protected. We have now found that particular elastomeric polymers or blends of elastomeric polymers, together with selected sun-screening agents when used, placed in intimate contact with and baked on the woven product results in a highly acceptable woven fencing product.

As used herein, the term elastomeric finish includes, but is not limited to, methyl, ethyl and butyl acrylate polymers, copolymers and blends thereof, butyl rubber, chlorinated butyl rubber, plasticized vinyl chloride polymers, polychloroprene (neoprene), polyurethane, and chlorosulfonated polyethylene.

There are a number of acceptable polymer finishes as described herein for the woven fabric that will result in a fabric fence having desirable properties. For example, when making a woven product for use as a snow fence, polymers made from a blend of methyl, ethyl, and butyl acrylate monomers provide an acceptable coating composition, having a predictable glass transition point that, when applied to the woven product, will make the resulting fencing firm at about 50° to 70° F. yet as the ambient temperature decreases to and below freezing the resulting fence will be somewhat more rigid thereby improving its aerodynamic properties. Generally, the glass transition point of the elastomeric composition employed will be selected in the range of about 100° F. to about −30° F. For most applications, the glass transition point will be in the range of about 50° F. to about −10° F. which is the preferred range.

Among the elastomeric finishing compositions are acrylic latex polymers and mixture of acrylic latex polymers. In addition to at least one acrylic latex polymer there usually are also present cross-linking agents, curing agents, ultra-violet light screens and protectors, together with the necessary thickeners, dispersing agents, colors, pigment bases and fillers.

Acrylic latex polymers suitable for use according to the present invention are nonionic, water-based, self-crosslinking acrylic emulsions and available commercially, for example, as Rhoplex HA-8, HA-12 and HA-16 as described in U.S. Pat. No. 3,157,562, the disclosure of which is hereby incorporated by reference. Blends of these polymers are also well suited. Copolymers of other acrylic materials such as ethyl acrylate containing less than five parts of a reactive monomer, for instance methyl methacrylate, commercially available as Hycar 2600×138 are also useful.

Synthetic rubber latices are also suitable finishing materials according to the present invention. Unchlorinated butyl rubber can be used, as for example the polymers disclosed in U.S. Pat. No. 2,356,128. Chlorinated butyl rubbers may also be used among which are substituted and branched butylenes, such as, for example, the isobutylene-multiolefin copolymers, unsaturated to the extent of about 1–2 mole percent, e.g. one having a specific gravity of 0.92, an average molecular weight of 450,000, known as polyisobutylene isoprene latex and commercially available as Enjay BP-100. Neoprene latices such as Latex 572 and the like are also suitable.

Neoprene or butyl rubber has been found to impart light resistance to the fencing product when used for erosion control on beaches or flat lands. Abrasion resistance is also imparted to the resulting woven product when butyl rubber is employed, which is particularly valuable when the fencing is installed where it is subject to high abrasion such as sand erosion.

Polyvinyl chlorides including plasticized polyvinyl chlorides are the basic polymeric materials for the preferred elastomeric materials. Polyvinyl chloride is commercially available as Geon 121 and carboxylated vinyl chloride as Geon 130×17. Carboxylated vinyl chloride, when combined with a melamine formaldehyde resin such as the methylated melamine formaldehyde commercially available as Aerotex P-225, forms a highly satisfactory bond with nylon or polyester yarn. Elastomeric impregnant compositions based on vinyl chloride do not flake, chalk off and bleed out in certain installations as other coating compositions. Solvent based elastomers such as chloroprene or chlorosulfonated polyethylene may be used to impart the properties of ultraviolet light stability, abrasion resistance, and fabric stability as well as Latex based compositions.

Cross-linking agents may be employed in conjunction with the above acrylic latex polymers and are generally of the melamine formaldehyde type as disclosed in U.S. Pat. No. 2,197,357 the disclosure of which is hereby incorporated by reference. Also useful are zinc di-n-butyldithiocarbomate (Butyl-Zimate), amine hydrochloride (Catalyst AC) and the melamine-formaldehyde condensate Aerotex Resin M-3. In addition to the above cross-linking agents, it has been found that certain pigments, viz. zinc oxide and titanium dioxide also act as cross-linking agents.

When elastomeric polymers are used antioxidant agents are preferably incorporated. Among those preferred are 2,2'-methylenebis(4-methyl-6-tertiarybutyl phenol) or butyl phenol antioxidant, commercially available as Antioxidant 2246, alkylated diphenyl amines, polybutylated bisphenol A, phenyl-beta-naphthylamine, diphenyl-beta-phenylene diamine and mixtures thereof.

Several pigments may be incorporated into the finishing composition including zinc oxide, titanium dioxide, phthalocyanine green, phthalocyanine blue, and chrome yellow among others depending upon the ultimate use for which the product is intended. These pigments are conveniently used as a paste and serve as an ultra-violet light screen for the underlying fiber. Although the choice of pigment is not critical, zinc and titanium dioxide are preferred. The dry materials are usually ball milled before incorporation with the liquid resins. The ball milling may continue for 6 to 48 hours; however, a period of 24 hours is generally sufficient. When the ultimate use of the finished fencing product is in contact with water for a period of time, as in swamps, marshes, streams, rivers and the like, a quantity of bactericide, fungicide or algaecide is included in the formulation. Examples are aqueous solutions of quaternary ammonium compounds commercially available as Hyamine 2389.

In the formulation of the finishing composition various compounding adjutants are employed as dispersing agents for the pigmented solids in water. For example, the various salts of polymeric acids, such as Tamol 731 (25% solids, specific gravity 1.104, freezing point −2° C.), are used. Thickening agents of the following type are used: A copolymer of methacrylic acid and a lower acrylate of the type disclosed in British Pat. No. 870,994, available as Rhoplex ASE-60; substituted cellulose derivatives such as carboxy methyl cellulose (Methocel 4000) and carboxy ethyl cellulose are also used, as well as known fillers such as calcium carbonate and the like. In this instance, the calcium carbonate acts as an acid scavenger.

Acetylene black is used with the elastomeric materials, generally not as a filler, but for its electroconductive properties. Also, the acetylene black serves to reinforce the neoprene latex, improve heat resistance and, by absorbing ultra-violet light, reduce deterioration by sunlight of the neoprene and underlying fabric. Acetylene black should only be ball milled for a relatively short period of time to retain these electroconductive properties.

The general proportions of the various ingredients in the finishing composition, when present, may be described as follows, expressed in parts by weight:

Elastomeric polymer: about 75 to 125 parts
Cross-linking or Plasticizing Agent: about 5 to 30 parts
Curing Agent (when present): about 0.1 to 10 parts
Pigment: about 5 to 40 parts
Dispersant for the Pigments (when present): about 0.1 to 10 parts
Thickening Agent (when present): about 0.1 to 10 parts
Anti-Oxidant (when present): about 0.1 to 10 parts The following are formulations which have been used to impregnate the woven fabric and have been found to be highly acceptable in producing the finished woven fencing product for the particular purpose to which the fencing is to be put.

| | Wet | Dry |
|---|---|---|
| FORMULATION I | | |
| Acrylic latex polymer as disclosed in U.S. Pat. No. 3,157,562 and commercially available as Rhoplex HA-16 or the acrylic latex polymer available as Hycar 2600 × 138 | 200 | 100 |
| Zinc oxide paste which is used as a cross-linking agent and ultra-violet light screening agent | 30 | 15 |
| Titanium dioxide paste used as an ultra-violet light screening agent, cross-linking agent and color base | 20 | 10 |
| Chrome yellow paste organic light screening pigment for ultra-violet light resistance and color base | 20 | 10 |
| Calcium carbonate powder used as an acid scavenger and filler | 40 | 20 |
| Triazinealdehyde resin as disclosed in U.S. Pat. No. 2,197,357 and available as a melamine formaldehyde condensate, used as a cross-linking agent | 6 | 5 |
| Amine hydrochloride curing agent | 3 | 0.3 |
| Acrylic acid as for example the lightly cross-linked acrylic emulsion copolymer of the type disclosed in British patent 870,994 commercially available as Rhoplex ASE-60, used as a thickener to hold mixed solids in suspension | 4 | 2.4 |
| Sodium salt of a polymer carboxylic acid as acrylic acid, commercially available as Tamol 731, as a dispersing agent for the solids present | 3 | 3 |
| Carboxyl methyl cellulose as a stabilizing agent | 10 | .02 |
| Water as needed to the solids, after which all solid materials are ball milled for 24 hours | | |
| FORMULATION II | | |
| Chloroprene latex commercially available as Neoprene 572 | 200 | 100 |
| Zinc oxide paste cross-linking agent and ultra-violet light screening agent | 30 | 15 |
| Acetylene black paste conductive carbon black | 100 | 50 |
| Acrylic acid such as the lightly cross-linked acrylic emulsion copolymer of the type disclosed | 6 | 5 |

-continued

| | Wet | Dry |
|---|---|---|
| in British patent 870,994 commercially available as Rhoplex ASE-60, used as a thickener to hold mixed solids in suspension | | |
| Carboxyl methyl cellulose such as Methocel 4000 | 10 | .025 |
| Cationic stabilizer commercially available as Hyamine 2389 | 6 | 6 |
| Sodium salt of a polymeric carboxylic acid as acrylic acid commercially available as Tamol 731, as a dispersing agent for the solids present | 4 | 4 |
| Water as needed to the solids, after which all solid materials are ball milled for 24 hours (with the exception of the acetylene black paste which is ball milled for about 5 minutes) | | |

A similar neoprene compound using dry rubber may be used to accomplish the same result, the milled compound being let down in aromatic solvents for application to the fencing fabric.

FORMULATION III

| | Wet | Dry |
|---|---|---|
| Polyisobutylene isoprene latex commercially available as Enjay BP-100 | 200 | 100 |
| Zinc oxide pigment paste cross-linking agent and ultra-violet light screen | 30 | 15 |
| Phthalocyanine green pigment paste color and ultra-violet light resistance | 20 | 8 |
| Titanium dioxide pigment paste cross-linking agent and ultra-violet light resistance | 20 | 10 |
| Calcium carbonate paste acid scavenger and filler | 40 | 20 |
| Butyl phenol antioxidant polymer stabilizer | 6 | 3 |
| Butyl zimate curing agent | 2 | 1 |
| Water-soluble rubber latex accelerator and curing agent, commercially available as Merac | 3 | 1.5 |
| Water as needed to the solids after which all solid materials are ball milled for 24 hours | | |

Formulation I imparts low temperature stiffness while remaining supple enough at 55° F. to conform to easy installation. A chemically resistant conductive impregnated finish is achieved with Formulation II while maintaining good ultraviolet light resistance and low temperature stiffness. Formulation III results in a fencing high in oxidation and abrasion resistance yet light resistant based on the flexible, noncrystallizing latex polymer employed.

FORMULATION IV

| | Parts |
|---|---|
| Carboxylated vinyl chloride commercially available as Geon 130 × 17 | 100 |
| Trioctyl trimellitate, commercially available as PX338 | 70 |
| Epoxidized soy bean oil, for ultra-violet protection and heat stabilization, commercially available as PX800 | 5 |
| Dibasic lead phosphate, stabilizer | 5 |

-continued

FORMULATION IV

| | Parts |
|---|---|
| commercially available as Dyphos | |
| Bactericide, commercially available as Onyx 172 | 0.5 |
| Calcium carbonate, filler and hydrochloric acid scavenger | 10 |
| Methylated melamine formaldehyde, commercially available as Aerotex P-225 | 10 |

FORMULATION V

| | |
|---|---|
| Vinyl chloride, commercially available as Geon 121 | 100 |
| Trioctyl trimellitate, commercially available as PX338 | 70 |
| Epoxidized soy bean oil for ultra-violet protection and heat stabilization commercially available as PX800 | 5 |
| Dibasic lead phosphate, stabilizer, commercially available as Dyphos | 5 |
| Bactericide, commercially available as Onyx 172 | 0.5 |
| Calcium carbonate, filler, available as Atomite | 10 |

FORMULATION VI

| | Parts |
|---|---|
| Carboxylated vinyl chloride, as Geon 130 × 17 | 100 |
| Diisodecyl phthalate, commercially available as PX 120 | 70 |
| Epoxidized soy bean oil, for ultra-violet protection and heat stabilization, commercially available as PX800 | 5 |
| Dibasic lead phosphate, stabilizer commercially available as Dyphos | 5 |
| Bactericide, commercially available as Onyx 172 | 0.5 |
| Calcium carbonate, filler and hydrochloric acid scavenger | 10 |
| Methylated melamine formaldehyde, commercially available as AerotexP-225 | 10 |

FORMULATION VII

| | |
|---|---|
| Vinyl chloride, as Geon 121 | 100 |
| Diisodecyl phthalate | 70 |
| Epoxidized soy bean oil, for ultra-violet protection and heat stabilization, commercially available as PX800 | 5 |
| Dibasic lead phosphate, stabilizer commercially available as Dyphos | 5 |
| Bactericide, commercially available as Onyx 172 | 0.5 |
| Calcium carbonate, filler and hydrochloric acid scavenger | 10 |

The finishing compositions disclosed herein may be applied to the woven fencing product in any convenient manner, as for example, by spraying, padding, backcoating and the like. The relative pick-up of the elastomeric composition varies, of course, depending on the nature of the synthetic polymer from which the product is woven, but usually falls within about 5 to 200 percent of the weight of the fabric; most applications will be between about 30 to about 80 percent of the weight of the fabric. In the preferred embodiment and for correct practice the finishing composition is applied by a plurality of pad rolls which apply the elastomeric composition to the woven product and impregnate the latter with the elastomeric composition. When using a latex-based impregnate, for example, the total is from about 0.5 ounces to about 2½ ounces of finish composition per square yard of product. After the elastomeric composition is applied, the moist product is then dried and cured through a series of three heated zones; the first 150° F., the second 250° F. and the final zone 400° F. The matrix temperatures as the product passes through the third consecutive zone is 305° F., it being recognized that a temperature of at least 300° F. is necessary to obtain the required cross-linking. However, operational temperatures are in the 275° to 350° F. range. The fabric proceeds through the three successive zones at a speed from about 10 to about 50 yards per minute. A similar method for the vinyl and rubber-based elastomeric finishing compositions as above is used, but at different temperatures. The vinyl-based finishing compositions generally fuse at about 280°–420° F. while those based on rubber have a curing temperature upwards of 275° F.

When thermoplastic materials such as nylon and polyester are treated it may be desirable in some instances to first apply a tie coat to the woven fibers before the application of the elastomeric coating composition. The tie coat improves the adhesion of the elastomeric composition to fibers of the thermoplastic materials. As an example of a suitable tie coat, Dupont's compound N.V.D. has been found to be acceptable for improving the adhesion of the foregoing vinyl-based Formulations IV-VII to nylon or polyester. Dupont's N.V.D. contains the following:

| | Parts |
|---|---|
| Bakelite VMCH | 100 |
| Dioctyl phthalate | 60 |
| Dibasic lead phosphate | 4 |
| Polymethylene polyphenylisocyanate or methylene Bis(4-phenylisocyanate) | 4 |

Flame-retardant materials may also be included in the elastomeric composition when the ultimate fencing has the possibility of exposure to open fires, as a barricade for ground or brush fires as well as other installations. Illustrative examples of such materials are antimony oxide, chlorinated waxes and, in the instance of vinyl systems, phosphate plasticizers. It is also possible in addition to or in lieu of the flame-retardants in the coating composition to employ fibers or yarns in the weaving of the fabric that have already been treated to impart a degree of flame-retardance.

The woven fabric of the present invention, as will be seen in the attached figure, has laterally spaced longitudinal bands extending in the warp direction only of relatively tightly woven warp and uniformly spaced apart filling strands separated by relatively open longitudinal bands containing only filling strands. The longitudinal bands having a pair of strands exteriorly along each side and the filling strands are bound together in groups of at least two, preferably three, filling strands by the pair of longitudinal strands to form a plurality of spaced apart filling strand groups extending along the length of the coated fabric. The open bands define open spaces therebetween, these open spaces between free from the elastomeric coating which is adhered to the surface of the fibers, and impregnated into each of the strands encapsulating every filament of every end and pick of the woven fabric. This permits passage of wind through said open spaces without damage to the coated, impregnated fabric while creating air currents.

What is claimed:

1. An improved weather-resistant fencing product comprising:

a length of fabric woven in a predetermined width from strands of tough, elastic, synthetic plastic material, said fabric having a relatively thin elastomeric, weather-resistant coating substantially evenly adhered to the surface of and impregnated into each of said strands thereby encapsulating and adhering said strands to each other to rigidify and support the woven product, and to render said product capable of withstanding sustained periods of direct sunlight, the relative thickness of said coating being no greater than the diameter of each of said strands, said woven fabric having laterally spaced longitudinal bands extending in the warp direction only of relatively tightly woven warp and uniformly spaced filling strands separated by relatively open longitudinal bands containing only filling strands, said longitudinal bands having a pair of strands exteriorly along each side thereof, said filling strands being bound together in groups of at least two filling strands by said pair of longitudinal strands to form a plurality of spaced apart filling strand groups extending along the length of said coated fabric, said open bands defining open spaces, the open spaces being free from said elastomeric coating thereby permitting passage of wind through said open spaces without damage to the coated, impregnated fabric while creating air currents.

2. The fencing product as claimed in claim 1 wherein the filling strands are bound together in groups of three filling strands each adhered to the other by and encapsulated in said elastomeric coating.

3. The fencing product of claim 1, wherein said elastomeric composition is selected from the group consisting of acrylate polymers, acrylate copolymers, butyl rubber, chlorinated butyl rubber, plasticized vinyl chloride polymers, polychloroprene, polyurethane, and chlorosulfonated polyethylene.

4. An improved weather-resistant snow fencing comprising:

a length of fabric woven in a predetermined width from strands of thermoplastic material selected from the group consisting of acrylic polymers, polypropylene, nylon and polyesters, said fabric having a relatively thin elastomeric, weather-resistant coating substantially evenly adhered to the surface of and impregnated into each of said strands thereby encapsulating and adhering said strand to each other to rigidify and support the woven product, and to render said product capable of withstanding sustained periods of direct sunlight, the relative thickness of said coating being no greater than the diameter of each of said strands, said woven fabric having laterally spaced longitudinal bands extending in the warp direction only of relatively tightly woven warp and uniformly spaced filling strands separated by relatively open longitudinal bands containing only filling strands, said longitudinal bands having a pair of strands exteriorly along each side thereof, said filling strands being bound together in groups of at least two filling strands by said pair of longitudinal strands to form a plurality of spaced apart filling strand groups extending along the length of said coated fabric, said open bands defining open spaces, the open spaces being free from said elastomeric coating thereby permitting passage of wind through said open spaces without damage to the coated, impregnated fabric while creating air currents.

5. The product of claim 4 wherein the fabric is nylon.

6. A woven fabric as shown in FIG. 1.

* * * * *